US007351963B2

(12) United States Patent
Rebettge et al.

(10) Patent No.: US 7,351,963 B2
(45) Date of Patent: Apr. 1, 2008

(54) MULTIPLE ROD SYSTEMS PRODUCED BY WIRE EROSION

(75) Inventors: Jens Rebettge, Schwanewede (DE); Thomas Wehkamp, Bremen (DE)

(73) Assignee: Bruker Daltonik, GmbH, Bremen (DE)

( * ) Notice: Subject to any disclaimer, the term of this patent is extended or adjusted under 35 U.S.C. 154(b) by 140 days.

(21) Appl. No.: 11/187,692

(22) Filed: Jul. 22, 2005

(65) Prior Publication Data

US 2006/0027745 A1 Feb. 9, 2006

(30) Foreign Application Priority Data

Aug. 3, 2004 (DE) ..... 10 2004 037 511

(51) Int. Cl.
*H01J 49/42* (2006.01)

(52) U.S. Cl. ..... 250/292

(58) Field of Classification Search ..... 250/292, 250/288, 282, 287, 310, 281
See application file for complete search history.

(56) References Cited

U.S. PATENT DOCUMENTS

| | | | | |
|---|---|---|---|---|
| 3,553,451 | A * | 1/1971 | Uthe | 250/290 |
| 3,819,941 | A | 6/1974 | Carrico | |
| 4,032,782 | A * | 6/1977 | Smith et al. | 250/292 |
| 4,490,648 | A * | 12/1984 | Lancaster et al. | 315/5.41 |
| 4,700,069 | A * | 10/1987 | Ino et al. | 250/292 |
| 5,384,461 | A * | 1/1995 | Jullien et al. | 250/292 |
| 5,525,084 | A * | 6/1996 | Broadbent et al. | 445/49 |
| 5,616,919 | A * | 4/1997 | Broadbent et al. | 250/292 |
| 5,852,270 | A * | 12/1998 | Holkeboer | 219/69.12 |
| 6,417,511 | B1 * | 7/2002 | Russ et al. | 250/292 |
| 6,441,370 | B1 * | 8/2002 | Khosla et al. | 250/292 |
| 6,515,279 | B1 * | 2/2003 | Baykut | 250/285 |
| 6,926,783 | B2 * | 8/2005 | Loucks, Jr. | 156/73.6 |
| 2003/0160168 | A1 * | 8/2003 | Speakman et al. | 250/288 |

FOREIGN PATENT DOCUMENTS

| | | | |
|---|---|---|---|
| DE | 27 16287 | C3 | 4/1977 |
| DE | 27 37 903 | B | 8/1977 |
| DE | 43 41 149 | C2 | 12/1993 |
| DE | 195 11 248 | A1 | 3/1995 |
| DE | 103 24 839 | A1 | 6/2003 |
| EP | 0 655 771 | A1 | 5/1995 |
| GB | 2315592 | A | 7/1997 |
| JP | 61-082653 | A | 4/1986 |
| WO | WO 92/21141 | A1 | 11/1992 |
| WO | WO 98/54752 | A1 | 12/1998 |

* cited by examiner

*Primary Examiner*—Robert Kim
*Assistant Examiner*—Johnnie L Smith, II
(74) *Attorney, Agent, or Firm*—Law Offices of Paul E. Kudirka

(57) ABSTRACT

The invention relates to a method of creating multipole systems carrying RF voltage which can be used as ion guides, mass-selective quadrupole filters or collision cells to fragment ions; and multipole systems manufactured according to this method. The invention provides a method which produces particularly inexpensive multipole systems by spark erosion with a wire cathode. The multipole rod system comprises only two pieces of metal for connection to the two phases of the RF voltage, and the two pieces of metal are adjusted with respect to each other by one or more identical insulating rings.

8 Claims, 4 Drawing Sheets

MULTIPLE ROD SYSTEMS PRODUCED BY WIRE EROSION

FIELD OF THE INVENTION

The invention relates to a method of manufacturing multipole rod systems carrying RF voltage which can be used as ion guides, mass-selective quadrupole filters or collision cells to fragment ions, and multipole systems manufactured according to this method.

BACKGROUND OF THE INVENTION

Several different types of manufacturing method for multipole systems have become known. For quadrupole systems used for analytical purposes, honed round rods, which were fitted into suitably ground ceramic rings and secured there, were used initially. Later, hyperbolically ground metal rods were used, which were screwed into internally calibrated glass cages. The glass cages were manufactured on a precisely ground core (KPG method for "calibrated precision glass") using a hot molding process. DE 27 37 903 (corresponding to U.S. Pat. No. 4,213,557) elucidates a method of manufacture which melts four long metal foils onto the hyperbolic interior surfaces of a similarly hyperbolic glass body during the hot molding phase of a KPG method, said foils serving as electrodes.

For the hexapole and octopole systems that are used as ion guides, round rods or capillaries are still used. The rods or capillaries have diameters of around 0.5 to 1.5 millimeters, usually around 0.8 millimeters; they are made from hard-drawn metal, usually stainless steel, and, in some cases, gold plated externally. They are secured by means of tack-welded tabs, which are screwed onto insulating rings with voltage supplies. This method of manufacture is not very reproducible, and the ion guides manufactured in this way are extremely sensitive to collisions and bending forces; they are also sensitive to mechanical or acoustic vibrations, which can cause them to resonate. They then often tear off at the tack-welded securing points. As supplied, the rods or capillaries are not very straight, and they have to be repeatedly restraightened, including after every processing operation.

Such ion guides are generally quite finely worked: the internal diameters of the rod system are usually only between two and four millimeters. Nevertheless, even slight bending, which leads to irregular internal diameters, can considerably reduce the ion transmission, or even block it completely. There is therefore a need for more stable multipole systems and for an inexpensive method of manufacture and inexpensive to manufacture.

SUMMARY OF THE INVENTION

The invention involves making a single-piece multipole rod body, combining together all the rods which have to be connected together to one phase of a two-phase RF voltage, from a piece of cylindric or otherwise elongated metal with an external retaining ring, in one processing step by wire erosion. This multipole rod body contains all the longitudinal rod electrodes for one phase of the two-phase RF voltage in one monolithic metal part. Two such metal multipole rod bodies assembled facing each other with a single insulating ring make up the complete multipole rod system. The external retaining ring must not be arranged centrally in relation to the length of the multipole system, but must preferably be displaced from the center by half the thickness of the insulating ring plus half the thickness of the external retaining ring.

If a multi-phase RF voltage is to be used, the number of metal multipole rod bodies which have to be joined together must correspond to the number of electrical phases to be used; each metal multipole rod body must carry precisely the number of electrodes that are to be connected to one phase of the RF.

A cylindrical metal block may be the stock for a hexapole system across a two-phase RF voltage. A multipole rod body with three hexapole rod electrodes may be manufactured by wire erosion from this original block, and an insulating ring, which contains groove-shaped recesses in the interior, can accommodate precisely two such multipole rod bodies facing each other and join them to form a multipole rod system. If the insulating ring also serves as a spacer for the external retaining rings of the multipole parts, there is no degree of freedom when assembling it.

Wire erosion, a modified version of spark erosion, has since developed into a precision method. It is used to produce very precise and smooth surfaces, as long as these surfaces are parallel. The dimensional accuracy of the surfaces is in the region of three micrometers. Surfaces of different parts can be very accurately adjusted with respect to each other by means of suitable mounts. The metal multipole rod bodies can be manufactured from aluminum, stainless steel, brass and many other materials, aluminum being particularly easy to work. The surfaces facing the axis of the multipole rod electrode system can be produced in both a cylindrical as well as in a hyperbolic form by suitable programming of the spark erosion machine.

The insulating rings can be manufactured from glass, ceramic and preferably from plastic. Very precise and low-shrinkage parts can be manufactured out of plastics with mineral fillers. Long multipole systems can also be held by several identical insulating rings. It is advisable to make the insulating ring and the metal multipole rod bodies from materials with the same coefficient of thermal expansion. Plastics can be given approximately the same coefficient of thermal expansion as many metals by the use of mineral fillers.

BRIEF DESCRIPTION OF THE DRAWINGS

The above and further advantages of the invention may be better understood by referring to the following description in conjunction with the accompanying drawings in which.

DETAILED DESCRIPTION

Figure 1:
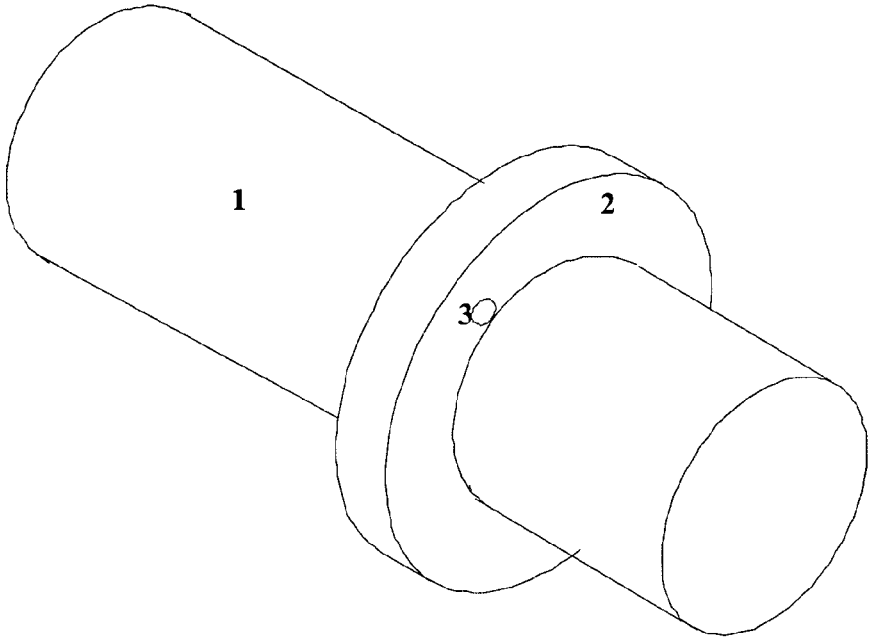
FIG. 1 shows a lathe produced cylindric Block which is to be made into a single-piece hexapole rod body with three hexapole electrodes by wire erosion. The part has an external retaining ring which later holds the hexapole electrodes together.

The manufacture of a hexapole ion guide begins with the manufacture of a metal block (FIG. 1) comprising a cylinder (1), from which three longitudinal electrodes will later be formed, and an external retaining ring (2) for later holding the three longitudinal electrodes, which is formed on the cylinder by lathing. The external retaining ring is drilled through at one point (3) so that the wire for the wire erosion can be threaded through. The external retaining ring (2) is not positioned centrally on the cylinder (1) but offset laterally in order to facilitate a simple joining of two hexapole parts so that they face each other at a later stage.

The wire erosion is carried out in a moving organic liquid, for example petroleum, transformer oil or high-vacuum pump oil, in order to continuously remove the particles created during the erosion. The wire is moved precisely and continuously in the longitudinal direction. The clamped workpiece is moved in such a way that it follows the predetermined erosion contours. The wire erosion has a dimensional accuracy better than three micrometers.

Figure 2:
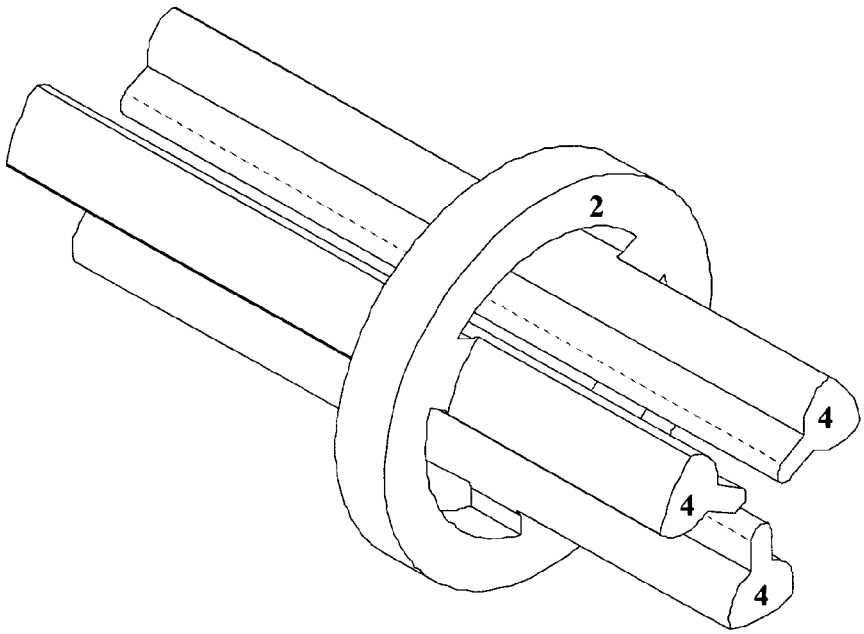
FIG. 2 shows the finished hexapole rod body after wire erosion in perspective view.
Figure 3:
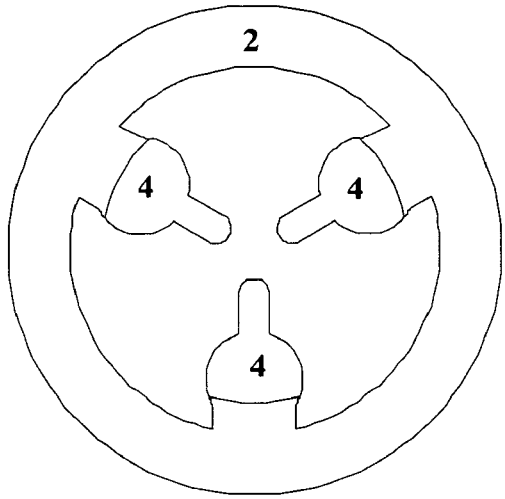
FIG. 3 shows the finished hexapole rod body in side-view.
Figure 4:
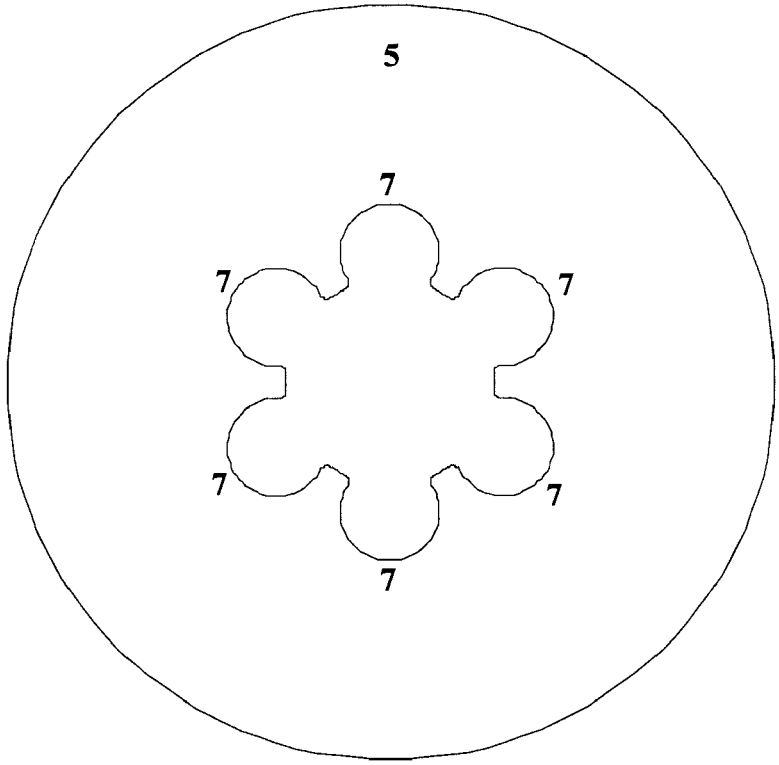
FIG. 4 shows an insulating ring made of an insulating material, with round interior grooves to accommodate the round parts of the hexapole rod electrodes.
Figure 5:
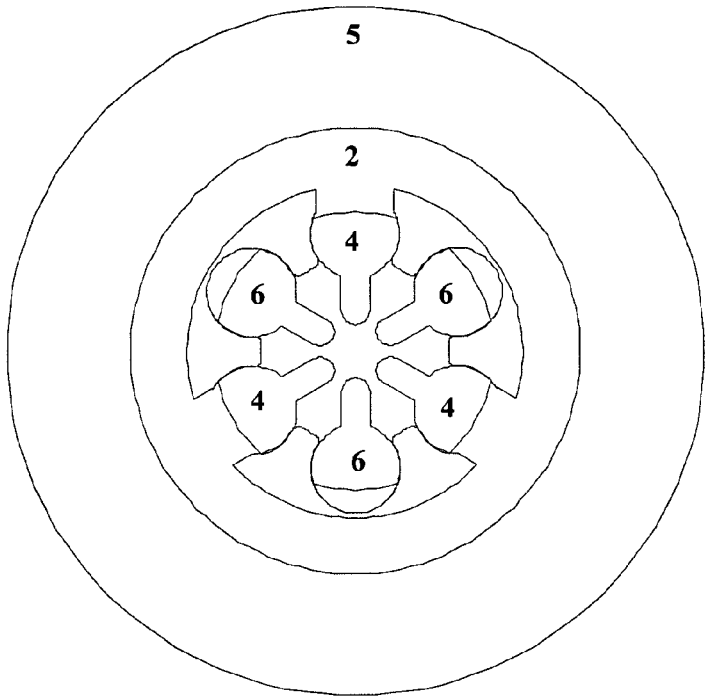
FIG. 5 shows an assembled hexapole rod system in end view.
Figure 6:
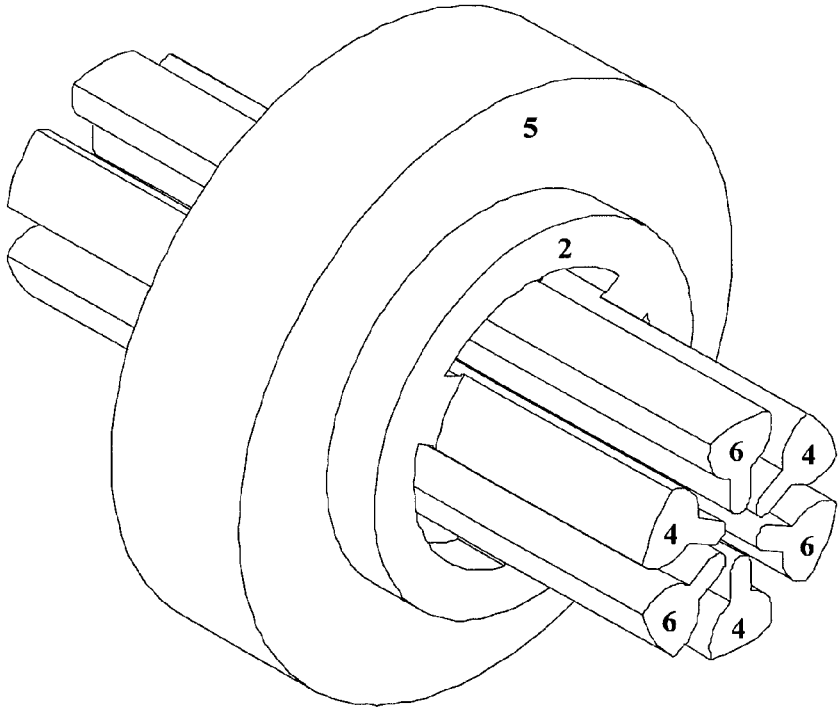
FIG. 6 shows the assembled hexapole rod system in perspective view.

FIG. 2 shows a finished hexapole rod body with the three longitudinal rod electrodes (4) on the external retaining ring (2) as a perspective representation; FIG. 3 shows an end view. Two such hexapole rod bodies, each having three longitudinal electrodes, now have to be joined to form a hexapole rod system. This is achieved by using the insulating ring (5) reproduced in FIG. 4, which has circular mounting grooves (7) for the circular external surfaces of the hexapole electrodes. FIGS. 5 and 6 show the end view and the perspective representation of the finished assembled hexapole rod system with three hexapole electrodes (4) for one phase and three hexapole electrodes (6) for the other phase of the RF voltage. The insulating ring (5) also serves here as a spacer between the two external retaining rings (2). The adjustment is very simple and leaves the assembly process with no degrees of freedom.

Longer rod systems can, in addition, be kept parallel by means of additional insulating rings which are mounted on the ends. The rod systems can be secured by screwing through the external retaining rings (2) and insulating rings (5), or simply glued. The external retaining rings (2) can contain internal threads for screwing on contact tags.

In contrast to a 12 centimeter long hexapole rod system with 3 millimeter inside diameter made of 6 pieces of wire, which has a capacitance of 18 picofarads, the spark-eroded hexapole system in FIG. 6 has a capacitance of around 30 picofarads. The change in capacitance is easy to accommodate.

Basically, any metal and any metal alloy can be used as the material for the multipole rod bodies with the longitudinal electrodes. The use of a hard aluminum alloy is very inexpensive since, in this case, the speed of erosion is particularly high. The aluminum alloy can be nickel-plated by electrolyses when the multipole rod bodies are finished in order to prevent the aluminum from oxidizing, and hence the possibility of charges forming on the surface.

If aluminum is used for the multipole rod bodies, a suitable material for the insulating ring (13) is, for example, PTFE (polytetrafluoroethylene) with a mica filling, since this makes it possible to set a uniform coefficient of thermal expansion of $23\times10^{-6}$ per degree Celsius.

Figure 7:
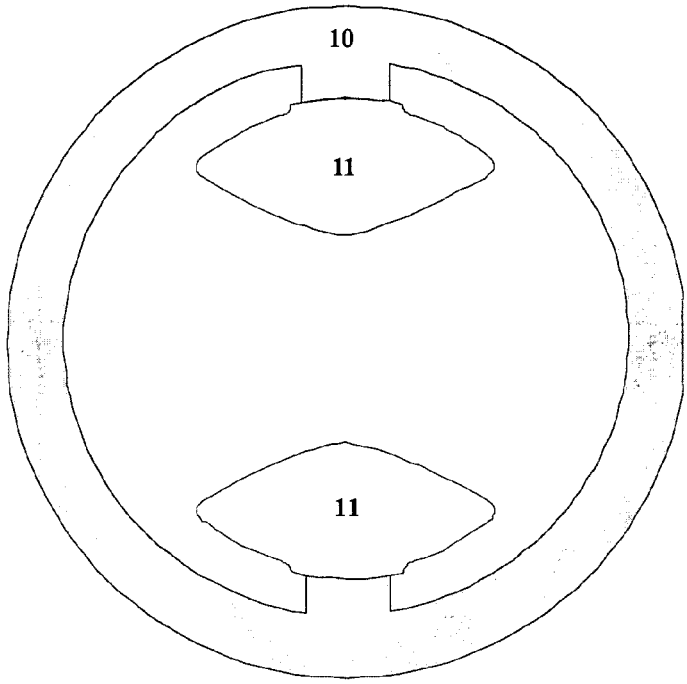
FIG. 7 shows the end view of a wire-eroded multipole rod body for a quadrupole system with hyperbolic interior surfaces.
Figure 8:
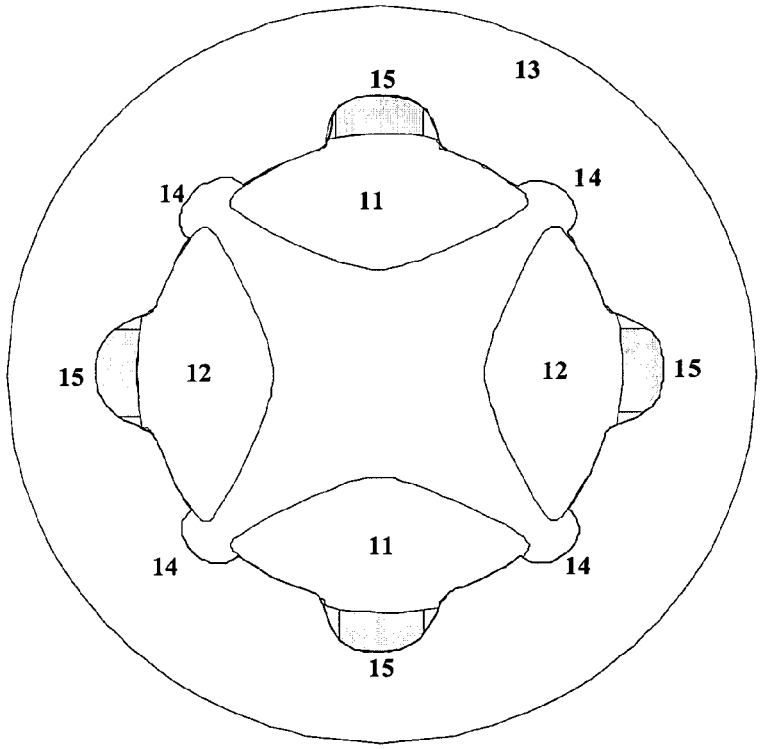
FIG. 8 shows the assembled quadrupole system with an insulating ring (13) which adjusts the quadrupole electrodes with respect to each other.

This method of manufacture can be used to produce not only hexapole and octopole ion guides but also quadrupole rod systems, which can be used both as analytical systems for ion selection and also as collision cells for the fragmentation of ions. FIG. 7 depicts the end view of a wire-eroded quadrupole rod bodies with two hyperbolic electrodes (11) on an external retaining ring (10). As demonstrated in FIG. 8, two such quadrupole rod pieces with two longitudinal electrodes (11) and two longitudinal rod electrodes (12) each can be joined using an insulating ring (13) with recesses (14) and (15) to form a complete quadrupole rod system. The insulating ring (13) holds the rod electrodes (11) and (12) on their wire-eroded external surfaces since, during the manufacturing process, it is not always possible to align the wire-eroded surfaces and the lathed surfaces so as to be completely parallel.

The quadrupole rod systems produced by this very inexpensive method are of particular interest for use as collision cells for collisionally induced fragmentation of ions. In the gas-filled collision cells, ions injected with energies of between 30 and 100 electron-volts (eV) can be fragmented at pressures of $10^{-2}$ to $10^{+2}$ Pascal. Their motion through the collision gas is also damped and the ions collect finally in the longitudinal axis of the quadrupole rod system, because the system in cross-section has a parabolic pseudopotential for all diameters, which drives the ions back to the axis in each case.

To achieve particularly efficient guidance of the fragment ions out of the collision cell, it is advisable to have a slight DC voltage drop in the order of one volt along the axis of the quadrupole system in order to guide the ions to the exit of the system. For a quadrupole rod system which makes it possible to set this type of DC voltage drop, the quadrupole rod body shown in FIG. 7 can again be used. It is made of aluminum and then oxidized by electrolyses so that an insulating layer is formed on all the surfaces. The two hyperbolic surfaces facing the axis, including the end surfaces, are then coated with a resistance layer, along which, following assembly, a slight voltage drop can be generated by means of suitable connections.

In a different form of operation, the resistance layer can be used to generate a dipolar excitation voltage between the two electrodes (11). This dipolar excitation can similarly be used to fragment the ions.

It is thus possible, according to the invention, to use wire erosion to produce various types of multipole rod systems at a very reasonable price. The multipole rod systems are operated with RF voltages and can be used in a multiplicity of ways for ion guidance, analytical ion selection and collision-induced fragmentation. The multipole rod systems can also serve as the basis for the manufacture of systems which, in addition, can provide DC voltage drops along the axis or dipolar excitation voltages transverse to the system.

With knowledge of the invention, those skilled in the art can develop further applications.

What is claimed is:

1. Method for the manufacture of a multipole rod system which can be used, for instance, as an ion guide, mass filter or collision cell when connected to a two-phase RF voltage, comprising the following steps:

a) manufacture of a plurality of elongated metal blocks, each block having an external retaining ring which will later hold together multipole rod electrodes for one RF phase, b) manufacture of a plurality of single-piece multipole rod bodies, each rod body being manufactured from one of the metal blocks with all the longitudinal rod electrodes that are to be connected to one of the two RF phases formed integrally with the retaining ring of that block, by wire erosion, c) manufacture of insulating rings with precision surfaces to accommodate the longitudinal rod electrodes, and d) joining of two multipole rod bodies and at least one insulating ring to form a multipole system.

2. Method according to claim 1, wherein the precision surfaces of the insulating rings hold those surfaces of the electrodes which were created by wire erosion.

3. Multipole system with longitudinal rod electrodes, comprising two single-piece monolithic metal multipole rod bodies, each comprising an external retaining ring, and all the longitudinal rod electrodes for one of the two phases of an RF voltage, and at least one insulating ring with precision surfaces to accommodate the longitudinal rod electrodes.

4. Multipole rod system according to claim 3, wherein the single-piece multipole rod bodies and the insulating rings have the same coefficient of thermal expansion.

5. Multipole rod system according to claim 3, wherein the single-piece multipole rod bodies are manufactured from aluminum or an aluminum alloy.

6. Multipole rod system according to claim 3, forming a quadrupole rod system made of four hyperbolic rod electrode surfaces on two quadrupole rod bodies.

7. Multipole rod system according to claim 6, wherein an insulated resistance layer is applied to the hyperbolic electrode surfaces.

8. Method for the manufacture of a multipole rod system which can be used as an ion guide when connected to a multi-phase RF voltage, comprising the following steps:

a) manufacture of elongated metal blocks, each block having an external retaining ring which will later hold together multipole electrodes of one RF phase, b) manufacture of a plurality of single-piece multipole rod bodies, each rod body being manufactured from one of the metal blocks with all longitudinal electrodes that are to be connected to one of the RF phases formed integrally with the retaining ring of that block, by wire erosion, c) manufacture of insulating rings with precision mounting surfaces to accommodate the longitudinal electrodes, and d) joining of as many multipole rod bodies as there are phases of the RF voltage and at least one insulating ring to form a multipole system.

* * * * *